US009709306B2

(12) United States Patent
Hyun et al.

(10) Patent No.: US 9,709,306 B2
(45) Date of Patent: Jul. 18, 2017

(54) SUCTION PIPE AND CAPILLARY TUBE ARRANGEMENT FOR A REFRIGERATOR

(71) Applicant: SAMSUNG ELECTRONICS CO., LTD., Suwon (KR)

(72) Inventors: Yong Seop Hyun, Suwon (KR); Sung Ju Bae, Busan (KR); Young Jae Song, Gwangju (KR); Sinn Bong Yoon, Gwangju (KR); Jong Chul Choi, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 553 days.

(21) Appl. No.: 13/773,059

(22) Filed: Feb. 21, 2013

(65) Prior Publication Data

US 2013/0219951 A1 Aug. 29, 2013

(30) Foreign Application Priority Data

Feb. 24, 2012 (KR) ..... 10-2012-0018935

(51) Int. Cl.
*F25B 41/06* (2006.01)
*F25B 41/00* (2006.01)

(52) U.S. Cl.
CPC ..... *F25B 41/003* (2013.01); *F25B 41/067* (2013.01); *F25B 2400/052* (2013.01); *Y10T 29/49826* (2015.01)

(58) Field of Classification Search
CPC ..... F25B 2400/052; F25B 2400/054; F25B 41/003; F25B 41/067
USPC ..... 138/142, 153
See application file for complete search history.

(56) References Cited

U.S. PATENT DOCUMENTS 2,505,934 A * 5/1950 Aughey ..... F25B 41/067 62/474
2,530,648 A 11/1950 Cahenzli, Jr. et al.
2,990,698 A * 7/1961 Crotser ..... F25B 43/006 62/503
3,566,615 A 3/1971 Roeder, Jr.
(Continued)

FOREIGN PATENT DOCUMENTS

DE 195 06 904 A1 2/1995
JP 11-2474 1/1999
(Continued)

OTHER PUBLICATIONS

English Abstract translation of JP2009250600.*
(Continued)

*Primary Examiner* — Ryan J Walters
*Assistant Examiner* — Erik Mendoza-Wilkenfe
(74) *Attorney, Agent, or Firm* — Staas & Halsey LLP

(57) ABSTRACT

A structure of a suction pipe provided with a capillary tube having a spiral shape being inserted into an inside thereof, capable of easily fixing the capillary tube to the suction pipe, and a refrigerator having the same, the refrigerator including a suction pipe, and a capillary tube having a spiral portion being inserted into the inside the suction pipe, the suction pipe including a first wall making contact with the spiral portion, a second wall making contact with the spiral portion while facing the first wall, and a connecting wall configured to connect the first wall to the second wall while being spaced apart from the spiral portion.

10 Claims, 8 Drawing Sheets

(56) References Cited

U.S. PATENT DOCUMENTS

| | | | | |
|---|---|---|---|---|
| 4,394,344 | A * | 7/1983 | Werner | F28D 15/0233 165/104.26 |
| 2006/0096744 | A1* | 5/2006 | Nakamura | F16L 7/00 165/154 |
| 2007/0215333 | A1* | 9/2007 | Viklund | F25B 40/06 165/172 |
| 2008/0016904 | A1* | 1/2008 | Eberle | F25B 39/022 62/498 |
| 2011/0220237 | A1* | 9/2011 | Okamoto | B21C 1/22 138/140 |
| 2012/0060543 | A1* | 3/2012 | Hanley | F25B 40/00 62/440 |
| 2012/0211209 | A1* | 8/2012 | Choi | F16L 19/086 165/178 |

FOREIGN PATENT DOCUMENTS

| | | | |
|---|---|---|---|
| JP | 11-304337 | | 11/1999 |
| JP | 11304337 | A * | 11/1999 |
| JP | 2009250600 | A * | 10/2009 |

OTHER PUBLICATIONS

English translation of JP11002472A.*
Machine Translation of JPH11304337; Nov. 1999.*
Extended European Search Report issued Jun. 7, 2016 in related European Patent Application No. 13156580.6.

* cited by examiner

SUCTION PIPE AND CAPILLARY TUBE ARRANGEMENT FOR A REFRIGERATOR

CROSS-REFERENCE TO RELATED APPLICATIONS

This application claims the benefit of Korean Patent Application No. 10-2012-0018935, filed on Feb. 24, 2012, in the Korean Intellectual Property Office, the disclosure of which is incorporated herein by reference.

BACKGROUND

1. Field

Embodiments of the present disclosure relate to a refrigerator including a suction pipe provided with a capillary tube inserted therein.

2. Description of the Related Art

A refrigerator is an apparatus configured to keep foods fresh by having a storage compartment, and a cool air supplying apparatus to supply cool air at the storage compartment. The cold air supplying apparatus includes a compressor to compress refrigerant at high temperature and high pressure. The condenser configured to liquefy the compressed refrigerant by exchanging heat, an expansion valve to expand the refrigerant, and an evaporator to cool the surroundings thereof by evaporating the refrigerant, and supplies cool air at the storage compartment by repeatedly rotating a cooling cycle.

As for the expansion valve of the refrigerator, a capillary tube could be used. The capillary tube as such is attached to an outer circumferential surface of a suction pipe that connects the evaporator to the compressor, or is inserted into an inside the suction pipe. Thus, the room-temperature or high-temperature refrigerant entered into the capillary tube exchanges heat with the low-temperature refrigerant at an inside the suction pipe, thereby preventing the phenomenon of having dew formed on an outer surface of the suction pipe, and the expansion efficiency of the capillary tube is increased while the load of the compressor is decreased.

Meanwhile, a refrigerator, which is provided with a capillary tube inserted in a form of a spiral into an inside a suction pipe, as to increase the heat-exchanging efficiency by expanding an heat exchanging area, is present, and one example of the refrigerator as such has been suggested in Japanese patent publication No. 11-2474. In accordance with the above publication, the capillary tube is disposed at an inside the suction pipe so that the capillary tube may be in contact with an inner circumferential surface of the suction pipe in a form of a spiral, and on the inner circumferential surface of the suction pipe, a spiral groove is formed, so that the capillary tube is inserted into the spiral groove and is fixed. The structure as such is needed to be provided with the spiral groove formed on the inner circumferential surface of the suction pipe, and thus a processing is complicated.

SUMMARY

Therefore, it is an aspect to provide a structure of a suction pipe capable of enabling fixing a capillary tube having a spiral shape in a simple manner without a processing of an inner circumferential surface of the suction pipe when the capillary tube having a form of a spiral is fixed to the inside the suction pipe.

It is another aspect to provide a structure of a suction pipe provided with light weight and reduced material cost while being easily joined to an evaporator pipe and a compressor pipe.

Additional aspects will be set forth in part in the description which follows and, in part, will be obvious from the description, or may be learned by practice of the disclosure.

In accordance with one aspect, a refrigerator includes a compressor, a condenser, a capillary tube, an evaporator and a suction pipe. The compressor may be configured to compress refrigerant. The condenser may be configured to condense the refrigerant being introduced from the compressor. The capillary tube may be configured to expand the refrigerant being introduced from the condenser. The evaporator may be configured to evaporate the refrigerant being introduced from the capillary tube to absorb heat of a surrounding environment and to cool the surrounding environment. The suction pipe may be configured to guide the refrigerant being discharged from the evaporator to the compressor. The capillary tube may include a spiral portion disposed in a form of a spiral at an inside the suction pipe so as to directly exchange heat with the refrigerant at an inside the suction pipe. The suction pipe may include a first wall, a second wall and a connecting wall. The first wall may make contact with the spiral portion. The second wall may make contact with the spiral portion and facing the first wall. The connecting wall may be spaced apart from the spiral portion and configured to connect the first wall to the second wall.

The first wall and the second wall may be provided with a flat and leveled shape, and the connecting wall may be provided with a curved shape.

The spiral portion may be fixed by forces of the first wall and the second wall, which oppose each other.

The suction pipe may include a first pipe and a plurality of second pipes. The first pipe may be provided with the spiral portion being disposed at an inside thereof. The plurality of second pipes may be coupled to both end portions of the first pipe.

The first pipe may be coupled to the plurality of second pipes by welding.

The capillary tube may pass through welding portions at which the first pipe is welded to the plurality of second pipes.

The first pipe may be formed of aluminum, and the second pipe may be formed of copper.

The refrigerator may further include a contraction tube. The contraction tube may be configured to surround the suction pipe to prevent corrosion of the suction pipe.

The spiral portion of the capillary tube may include a first pressing part and a second pressing part. The first pressing part may make contact with the first wall and have a flat and leveled shape. The second pressing part may make contact with the second wall and have a flat and leveled shape.

In accordance with one aspect, a refrigerator includes a compressor, a condenser, a capillary tube, an evaporator, an evaporator pipe, a compressor pipe, and a suction pipe. The compressor may be configured to compress refrigerant. The condenser may be configured to condense the refrigerant being introduced from the compressor. The capillary tube may be configured to expand the refrigerant being introduced from the condenser. The evaporator may be configured to evaporate the refrigerant being introduced from the capillary tube to absorb heat of a surrounding environment and to cool the surrounding environment. The evaporator pipe may be connected to a discharging port of the evaporator. The compressor pipe may be connected to an intake port of the compressor. The suction pipe may be configured to connect the evaporator pipe to the compressor pipe to guide the refrigerant being discharged from the evaporator to the compressor. The suction pipe may include a first pipe and a plurality of second pipes. The plurality of second pipes may e coupled to both end portion of the first pipe. Welding portions may be configured to couple the first pipe to the second pipes. The capillary tube may pass through the welding portions while at least one portion of the capillary tube may be disposed at an inside the first pipe.

Each of the first pipe and the plurality of second pipes may be formed of different material. The plurality of second pipes, the evaporator pipe, and the compressor pipe may be formed of same material.

The first pipe may be formed of aluminum. The plurality of second pipes, the evaporator pipe, and the compressor pipe may be formed of copper.

The capillary tube being inserted into an inside the suction pipe may be provided in a spiral shape so that a heat transfer area with the refrigerant at an inside the suction pipe may be expanded.

In accordance with another aspect, a method of manufacturing a suction pipe assembly provided with a first pipe, a plurality of second pipes being coupled to both end portions of the first pipe to form a suction pipe in cooperation with the first pipe, and a capillary tube which has a spiral shape and at least a portion of which is inserted into an inside the first pipe may be as follows. A first pipe, a plurality of second pipes to be coupled to both end portions of the first pipe, and a capillary tube may be prepared. At least one portion of the capillary tube may be formed in a spiral shape having an outer diameter smaller than an inner diameter of the first pipe. The spiral-shaped portion of the capillary tube may be inserted into an inside the first pipe through openings of the both end portions of the first pipe. The second pipes may be coupled to the both end portions of the first pipe, respectively, by welding. The spiral-shaped portion of the capillary tube may be fixed to an inside the first pipe by pressing the first pipe.

When the second pipes are welded to the both end portions of the first pipe, respectively, a remaining portion except for the spiral-shaped portion of the capillary tube may be guided to an outside the suction pipe through welding portions at which the first pipe is welded to the second pipes.

The method may be achieved by further performing the following. A contraction tube may be covered on the suction pipe to prevent corrosion of the suction pipe.

In accordance with the aspect, through a simple processing of a spiral-shaped capillary tube being pressed to the suction pipe, the capillary tube may be easily and stably fixed and disposed at an inside the suction pipe.

In addition, the suction pipe is formed of the two different materials, which are copper and aluminum, and thereby the joining of the suction pipe to the surrounding pipes is convenient while achieving lightweight and material cost reduction.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
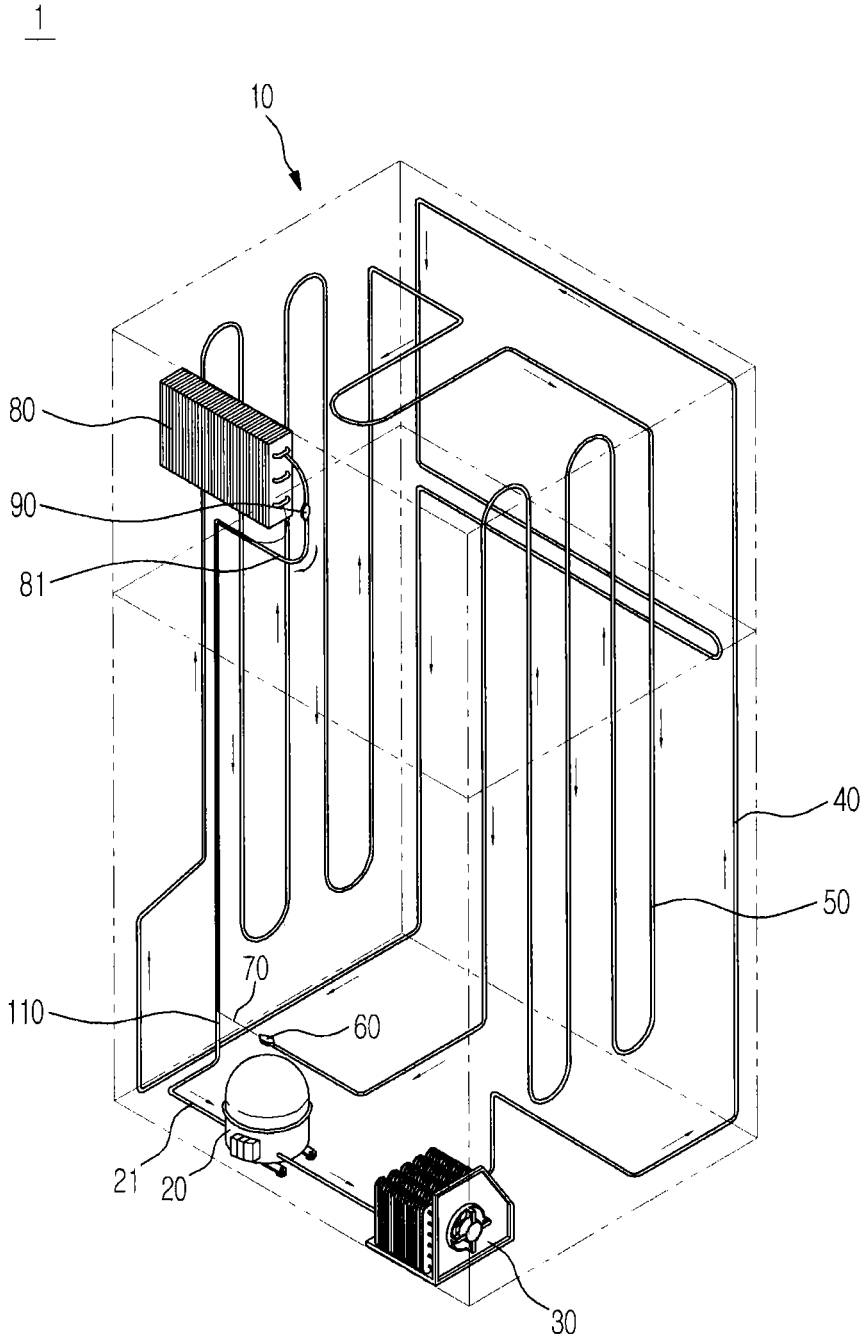
FIGS. 1 to 2 are drawings schematically illustrating a cooling apparatus of a refrigerator in accordance with an embodiment.

Reference will now be made in detail to the embodiments, examples of which are illustrated in the accompanying drawings, wherein like reference numerals refer to like elements throughout.

Figure 2:
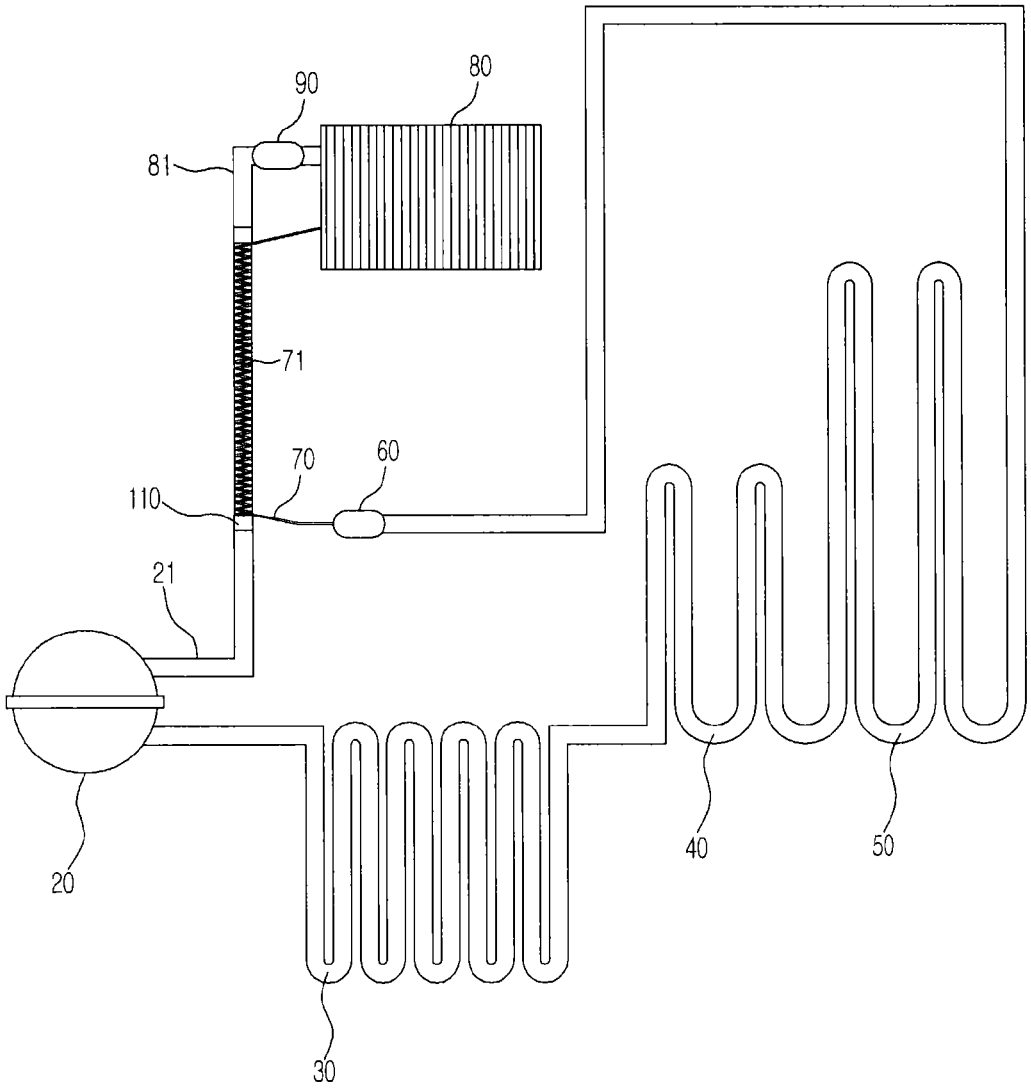

FIGS. 1 to 2 are drawings schematically illustrating a cooling apparatus of a refrigerator in accordance with an embodiment. Referring to FIGS. 1 to 2, a cooling apparatus of a refrigerator 1 in accordance with an embodiment includes a compressor 20 to compress refrigerant with high temperature and high pressure, a condenser 30 to condense the refrigerant being introduced from the compressor 20, a capillary tube 70 to expand the refrigerant being introduced from the condenser 30, and an evaporator 80 to generate cool air by evaporating the refrigerant being introduced from the capillary tub 70.

In between the condenser 30 and the capillary tube 70, a hot pipe 40 and a cluster pipe 50 are disposed evenly at the both side surfaces and the front surface of a body 10 to apply heat the both side surfaces and the front surface of the body 10 such that heat of the refrigerant, which is not sufficiently dissipated, is effectively dissipated and dew formation is prevented.

In between the cluster pipe 50 and the capillary tube 70, a dryer 60 may be provided to prevent the clogging of the capillary tube 70 by removing foreign substance such as moisture.

Although to be described in detail, the capillary tube 70 in accordance with an embodiment of the present disclosure is provided at least a portion thereof being inserted into an inside a suction pipe 110 that guides the refrigerant being discharged from the evaporator 80 to the compressor 20.

According to the structure as such, the liquefied refrigerant provided with room-temperature or high-temperature flowing along the capillary tube 70 may directly exchange hear with the low-temperature refrigerant at an inside the suction pipe 110. Particularly, a portion 71 of the capillary tube 70 that is being disposed at an inside the suction pipe 110 may be provided in a spiral shape so that the heat transfer area with the refrigerant is expanded. Hereinafter, the portion 71 of the capillary tube 70 disposed at an inside the suction pipe 110 while having a spiral shape will be referred to as the spiral portion 71.

Meanwhile, the suction pipe 110 is provided with one end portion thereof being connected to an evaporator pipe 81, which is a refrigerant pipe at a discharging side of the evaporator 80, while the other end thereof may be connected to a compressor pipe 21, which is an intake side of the compressor 20. Thus, the refrigerant discharged from the evaporator 80, by passing through the evaporator pipe 81, the suction pipe 110, and the compressor pipe 21 in order, may be guided to the compressor 20. Although will be described in detail, both end portions of the suction pipe 110 are formed of copper material, and thus the suction pipe 110 may be easily coupled to the evaporator pipe 81 and the compressor pipe 21, both of which are formed of the same copper material, by welding.

At this time, an accumulator 90 may be provided at the evaporator pipe 81 to accommodate the liquefied refrigerant that is not gasified at the evaporator 80.

Meanwhile, the refrigerator 1 illustrated on the drawing includes the one evaporator 80 and the one compressor 20, but the aspect of the present disclosure is not limited hereto, and the aspect of the present disclosure may be applied to a refrigerator having two or more evaporators 80 and two or more compressors 20 in the same manner.

Figure 3:
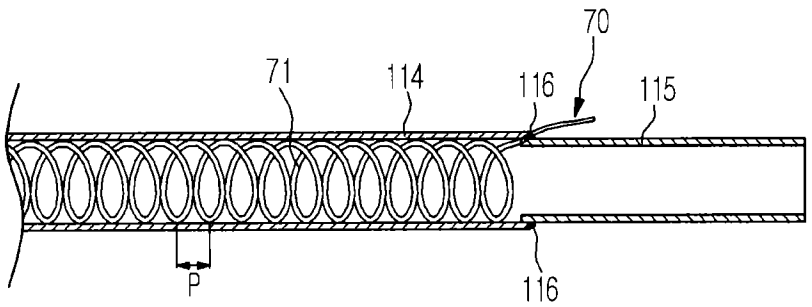
FIG. 3 is a cross-sectional view illustrating the suction pipe of the refrigerator of FIG. 1.
Figure 4:
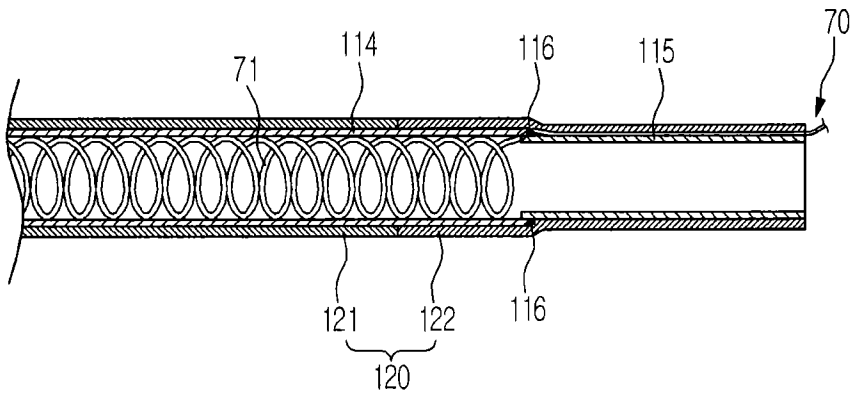
FIG. 4 is a cross-sectional view illustrating a status of a contraction tube covering the suction pipe of FIG. 2.
Figure 5:
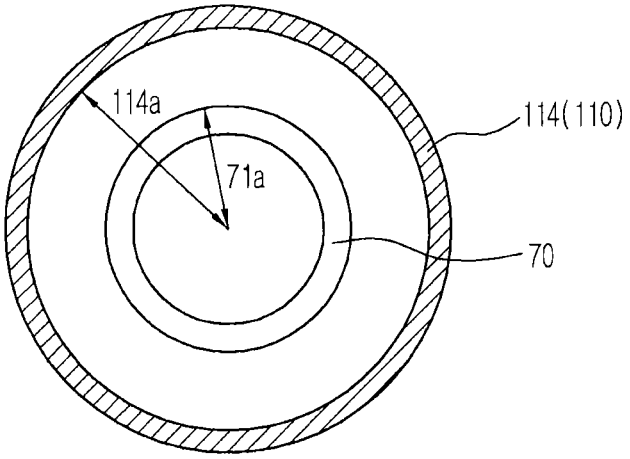
FIG. 5 is a longitudinal cross-sectional view illustrating the suction pipe of the refrigerator of FIG. 1.
Figure 6:
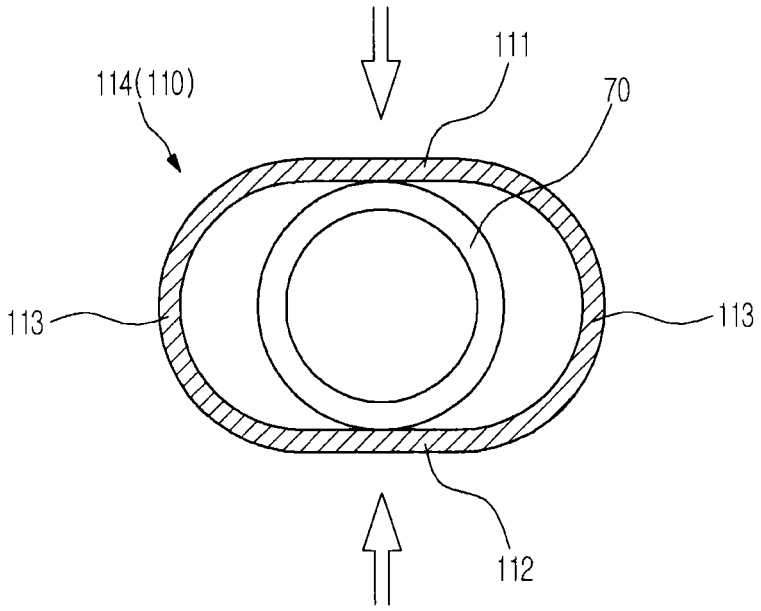
FIGS. 6 to 7 are drawings illustrating a process of a capillary tube being fixed to an inside the suction pipe by pressing the suction pipe of FIG. 1.
Figure 7:
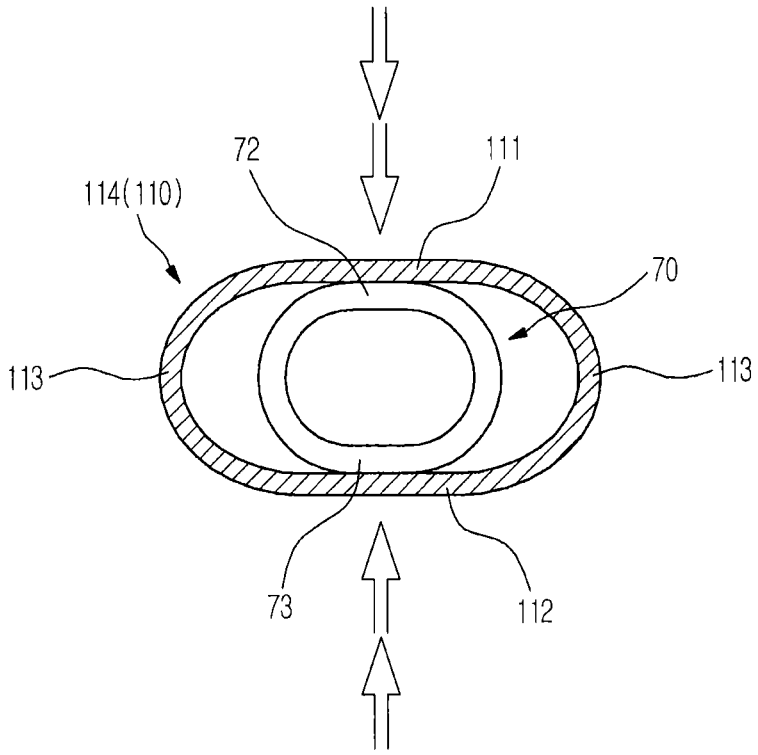

FIG. 3 is a cross-sectional view of a side of a suction pipe of the refrigerator of FIG. 1, FIG. 4 is a cross-sectional view of a status of a contraction tube covering the suction pipe of FIG. 2, FIG. 5 is a longitudinal cross-sectional view illustrating a suction pipe of the refrigerator of FIG. 1, and FIGS. 6 to 7 are drawings illustrating a process of a capillary tube being fixed at an inside a suction pipe by pressing the suction pipe of FIG. 1.

Referring to FIGS. 1 to 3, the suction pipe 110 in accordance with an embodiment of the present disclosure may include a first pipe 114, in which the spiral portion 71 of the capillary tube 70 is disposed, and a plurality of second pipes 115 being connected to both end portions of the first pipe 114.

On the drawing, it is illustrated that the end portions of the second pipes 115 are inserted into the openings of the both end portions of the first pipe 114, respectively, and coupled by welding. However, on the contrary, the end portions of the first pipe 114 may be inserted into the opening of the end portions of the second pipes 115, respectively, and coupled by welding.

Meanwhile, each of the remaining end portions of the plurality of second pipes 115 that are not coupled to the first pipe 114 may be welded and coupled to the evaporator pipe 81 or the compressor pipe 21.

The first pipe 114 may be formed of aluminum material that is lightweight and inexpensive, and the second pipes 115 may be formed of copper material so that the second pipes 115 may be easily joined with an outside refrigerant pipe, such as the evaporator pipe 81 or the compressor pipe 21, both of which are formed of copper material.

The first pipe 114 and the second pipes 115 may be welded at a lower temperature by using a welding rod that is exclusively prepared for aluminum, and the second pipes 115 and the outside refrigerant pipes may be welded at a higher temperature by using a welding rod containing silver Ag.

Meanwhile, the capillary tube 70, through the opening units of the both end portions of the first pipe 114, may be inserted into an inside the first pipe 114. At this time, the capillary tube 70 is provided with a portion thereof processed in a spiral shape, and an outer diameter 71*a* of the spiral portion 71 is formed smaller than an inner diameter 114*a* of the first pipe 114, so that the spiral portion 71 may be inserted into an inside the first pipe 114.

While the spiral portion 71 of the capillary tube 70 is inserted into the first pipe 114, the second pipes 115 may be coupled to the both end portions of the first pipe 114 by welding. At this time, the capillary tube 70, through a welding part 116, may be guided to an outside the suction pipe 110 from an inside the suction pipe 110. Thus, the spiral portion 71 of the capillary tube 70 is inserted into an inside the first pipe 114, and the remaining portion of the capillary tube 70 other than the spiral portion 71 passes through the welding part 116 to be disposed at an outside the suction pipe 110. In addition, the capillary tube 70 may not be disposed at an inside the second pipes 115.

The refrigerant in a gasified state and the refrigerant in an liquefied state that are passed through the evaporator 80 are mixed and may flow at an inside the suction pipe 110, and particularly, the refrigerant in a gasified state may flow at an central part of an inside the suction pipe 110, while the refrigerant in a liquefied state may flow at a wall surface part of an inside the suction pipe 110.

At this time, when the refrigerant in a liquefied state flowing along the wall surface part of the suction pipe 110 meets the spiral portion 71 of the capillary tube 70, the flow becomes irregular, and thus the refrigerant in a gasified state and the refrigerant in a liquefied state are mixed, thereby inducing noise. As to minimize the above, the spiral portion 71 of the capillary tube 70 may be provided in a predetermined uniform pitch P.

In addition, the spiral portion 71 of the capillary tube 70 may be shaken by the flow of the refrigerant at an inside the suction pipe 110, and thus noise may be generated as the spiral portion 71 of the capillary unit 70 is collided on the inner circumferential surface of the suction pipe 110. Therefore, the spiral portion 71 of the capillary tube 70 may be needed to be fixed to an inside the suction pipe 110.

Referring to FIG. 5, as previously described, the spiral portion 71 of the capillary tube 70, to be accommodated at an inside the suction pipe 110, is provided with the outer diameter 71*a* thereof formed smaller than the inner diameter 114*a* of the suction pipe 110. Here, in order for the two inner circumferential surfaces of the suction pipe 110 that face each other to be in contact with the spiral portion 71 of the capillary tube 70, the suction pipe 110 may be pressed from the both sides of the suction pipe 110 that opposite each other, the shape illustrated on FIG. 6 may be attained.

At this time, the suction pipe 110, as the shape thereof is changed, may include a first wall 111 being in contact with the spiral portion 71 of the capillary tube 70, a second wall 112 facing the first wall 111 and being in contact with the spiral portion 71 of the capillary tube 70, and a connecting wall 113 connecting the first wall 111 to the second wall 112 and being spaced apart from the spiral portion 71 of the capillary tube 70. Here, the first wall 111 and the second wall 112 are provided with a flat and leveled shape thereof, and the connecting wall 113 may have a curved shape.

With the structure as such, the spiral portion 71 of the capillary tube 70 may be fixed to an inside the suction pipe 110 by receiving the forces opposing each other from the first wall 111 and the second wall 112.

Meanwhile, under the state as the above, if the suction pipe 110 is pressed further, as illustrated on FIG. 7, the spiral portion 71 of the capillary tube 70 is changed in shape to have a further flattened shape, and thus the spiral portion 71 of the capillary tube 70 may be fixed in a further sturdy manner at an inside the suction pipe 110.

At this time, the spiral portion 71 of the capillary tube 70 may include a first pressing part 72 being in contact with the first wall 111 of the suction pipe 110 and having a flat and leveled shape, and a second pressing part 73 being in contact with the second wall 112 of the suction pipe 110 and having a flat and leveled shape.

Through the method as such, the spiral portion 71 of the capillary tube 70 may be easily fixed to an inside the suction pipe 110.

Meanwhile, as illustrated on FIG. 4, at an outer circumferential surface of the suction pipe 110, a contraction tube 120 may be covered to prevent corrosion of the suction pipe 110. Particularly, a polyvinyl chloride (PVC)-based contraction tube 121 may be covered on the outer circumferential surface of the first pipe 114 having aluminum material and a polyolefin-based contraction tube 122 having superior chemical resistance and elasticity may be covered on the welding parts 116 of the first pipe 114 and the second pipe 115.

Figure 8:
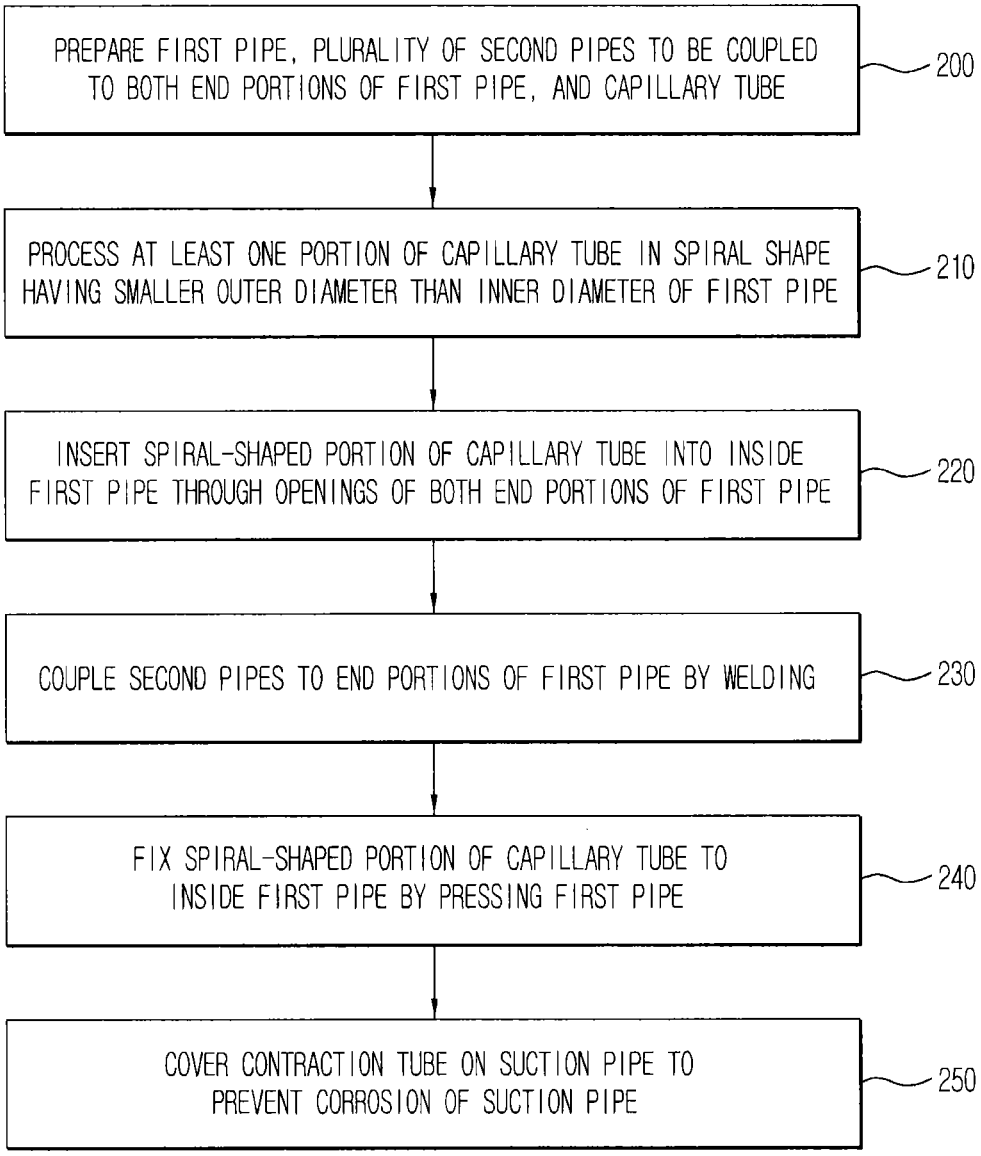
FIG. 8 is a flow chart showing a method of manufacturing a suction pipe in accordance with an embodiment.

FIG. 8 is a flow chart describing a manufacturing method of a suction pipe in accordance with an embodiment of the present disclosure, and by referring to FIG. 8, the manufacturing method of a suction pipe in accordance with an embodiment of the present disclosure will be briefly described.

First, the first pipe 114, the plurality of second pipes 115 to be coupled to both end portions of the first pipe 114 to form the suction pipe 110 in cooperation with the first pipe 114, and the capillary tube 70 (200)

Next, at least one portion of the capillary tube 70 is processed to a spiral shape having the smaller outer diameter 71*a* than the inner diameter 114*a* of the first pipe 114 (210).

Then, the spiral portion 71 of the capillary tube 70 is inserted into an inside the first pipe 114 through the opening units at the both end portions of the first pipe 114 (220).

Next, the second pipes 115 are coupled to the each of the both end portions of the first pipe 114 by welding. At this time, the remaining portion of the capillary tube 70 other than the spiral portion 71 of the capillary tube 70 is guided to an outside the suction pipe 110 through the welding parts 116 so as to be coupled to other refrigerant pipes (230).

Then, the spiral portion 70 of the capillary tube 70 is fixed to an inside the first pipe 114 by pressing the two surfaces of the first pipe 114 that are facing each other (240).

Finally, as to prevent the corrosion of the suction pipe 110, the contraction tube 120 is covered on the outer circumferential surface of the suction pipe 110 (250).

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a compressor configured to compress a refrigerant;

a condenser configured to condense the refrigerant being introduced from the compressor;

a capillary tube configured to expand the refrigerant being introduced from the condenser;

an evaporator configured to evaporate the refrigerant being introduced from the capillary tube to absorb heat of a surrounding environment and to cool the surrounding environment; and a suction pipe configured to guide the refrigerant being discharged from the evaporator to the compressor, the suction pipe including a first pipe having first and second ends, a first wall, having a flat and leveled shape, and a second wall, having a flat and leveled shape, facing each other, and a connecting wall having a curved shape and configured to connect the first wall to the second wall, a first second pipe connected to the first end of the first pipe, a second second pipe connected to the second end of the first pipe, a first welding portion coupling the first pipe to the first second pipe, and a second welding portion coupling the first pipe to the second second pipe;

wherein the capillary tube comprises a spiral portion disposed in a form of a spiral at an inside of the first pipe of the suction pipe, the spiral portion being in contact with both the first wall and the second wall of the first pipe and being spaced apart from the connecting wall of the first pipe, so as to directly exchange heat with the refrigerant at the inside of the suction pipe.

2. The refrigerator of claim 1, wherein:

the spiral portion is fixed by forces of the first wall and the second wall, which oppose each other.

3. The refrigerator of claim 1, wherein:

the capillary tube passes through at least one of the first welding portion and the second welding portion.

4. The refrigerator of claim 1, wherein:

the first pipe is formed of aluminum, and the first second pipe and the second second pipe are formed of copper.

5. The refrigerator of claim 1, further comprising:

a contraction tube configured to surround the suction pipe to prevent corrosion of the suction pipe.

6. The refrigerator of claim 1, wherein:

the spiral portion of the capillary tube comprises a first pressing part making contact with the first wall and having a flat and leveled shape, and a second pressing part making contact with the second wall and having a flat and leveled shape.

7. A refrigerator of claim 1, further comprising:

an evaporator pipe connected to a discharging port of the evaporator; and a compressor pipe connected to an intake port of the compressor, wherein the suction pipe connects the evaporator pipe to the compressor pipe to guide the refrigerant being discharged from the evaporator to the compressor.

8. The refrigerator of claim 7, wherein:

the first pipe is formed of a different material than the first second pipe and the second second pipe, and the first second pipe, the second second pipe, the evaporator pipe, and the compressor pipe are formed of a same material.

9. The refrigerator of claim 8, wherein:

the first second pipe, the second second pipe, the evaporator pipe, and the compressor pipe are formed of copper.

10. A refrigerator, comprising:

a compressor configured to compress a refrigerant;

a condenser configured to condense the refrigerant being introduced from the compressor;

a capillary tube configured to expand the refrigerant being introduced from the condenser;

an evaporator configured to evaporate the refrigerant being introduced from the capillary tube to absorb heat of a surrounding environment and to cool the surrounding environment; and a suction pipe configured to guide the refrigerant being discharged from the evaporator to the compressor, the suction pipe including a first pipe having first and second ends, a first wall and a second wall facing each other, and a connecting wall configured to connect the first wall to the second wall, a first second pipe connected to the first end of the first pipe, a second second pipe connected to the second end of the first pipe, a first welding portion coupling the first pipe to the first second pipe, and a second welding portion coupling the first pipe to the second second pipe;

wherein the capillary tube comprises a spiral portion disposed in a form of a spiral at an inside of the first pipe of the suction pipe, the spiral portion being in contact with both the first wall and the second wall of the first pipe and being spaced apart from the connecting wall of the first pipe, so as to directly exchange heat with the refrigerant at the inside of the suction pipe, and wherein the spiral portion of the capillary tube comprises a first pressing part making contact with the first wall and having a flat and leveled shape, and a second pressing part making contact with the second wall and having a flat and leveled shape.

* * * * *